US006265144B1

(12) United States Patent
Okuyama et al.

(10) Patent No.: US 6,265,144 B1
(45) Date of Patent: Jul. 24, 2001

(54) SILVER HALIDE EMULSION AND PHOTOGRAPHIC MATERIAL BY USE THEREOF

(75) Inventors: Masato Okuyama; Shigeo Tanaka, both of Odawara (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/469,695

(22) Filed: Dec. 22, 1999

(30) Foreign Application Priority Data

Dec. 29, 1998 (JP) ..... 10-377085

(51) Int. Cl.[7] ..... G03C 1/005; G03C 1/494

(52) U.S. Cl. ..... 430/569; 430/567; 430/944; 430/570; 430/559; 430/599

(58) Field of Search ..... 430/567, 569, 430/944, 570, 559, 599

(56) References Cited

U.S. PATENT DOCUMENTS

| | | | | |
|---|---|---|---|---|
| 5,190,855 | * | 3/1993 | Toya et al. | 430/599 |
| 5,508,161 | * | 4/1996 | Miyake et al. | 430/944 |
| 5,641,619 | * | 6/1997 | Haraguchi et al. | 430/569 |
| 5,882,837 | * | 3/1999 | Sawada | 430/944 |

* cited by examiner

*Primary Examiner*—Geraldine Letscher
(74) *Attorney, Agent, or Firm*—Frishauf, Holtz, Goodman, Langer & Chick, P.C.

(57) ABSTRACT

A method of preparing a silver halide emulsion is disclosed, comprising the steps of forming a silver halide emulsion, subjecting the silver halide emulsion to chemical sensitization, and adding a sensitizing dye the silver halide emulsion, wherein the sensitizing dye exhibits an absorption maximum at a wavelength of not less than 730 nm, the pAg of the emulsion being adjusted to a range of from 7.50 to 8.25 after strating the chemical sensitization and before adding the sensitizing dye.

8 Claims, No Drawings

SILVER HALIDE EMULSION AND PHOTOGRAPHIC MATERIAL BY USE THEREOF

FIELD OF THE INVENTION

The present invention relates to silver halide light sensitive color photographic materials and in particular, to silver halide color photographic materials having infrared-sensitivity and exhibiting high sensitivity and low fog.

BACKGROUND OF THE INVENTION

Recent pronounced advancements of solid state image sensors such as CCD and magnetic, electronic or optical recording medium in the field of electronics enabled easy picture-taking as in conventional silver photography, images can be instantly reproduced on television and stored in various recording mediums. Further, as a result of advances in scanners and image processing apparatuses in the field of printing and plate-making, operations such as editing or correcting with watching a color display and treatments such as magnification-reduction or contrast adjustment, after the original images are read, can be easily conducted. Along with such advances, a technique for obtaining high quality images from an image processing apparatus and a recording medium are desired and various types of outputting systems have been put to practical use, including a thermal transfer system, an ink-jet system and an electrophotography system.

Silver halide photographic materials are superior in representation of highlight and image lasting quality and techniques for applying them to digital image output have been developed. The reason why silver halide photographic materials are superior in representation is that silver halide photographic material, as a print material, can form images with little electronic noise. Accordingly, the difference in density which is perceptible in prints is regarded to be substantially in accord with the density difference perceptible by human eyesight.

Silver halide photographic materials are employed not only in photography but also in printing, in terms of high sensitivity, superior color reproducibility and suitability to rapid access. Specifically, the photographic material are employed in the field of so-called proofs to check the finished state prior to actual printing.

Although silver halide photographic materials are quite superior in representation and are broadly employed, conventional silver halide photographic materials have blue-, green- and red-sensitive silver halide emulsion layers, leading to problems such that light sources usable for recording are limited. To expose the silver halide photographic material to light for the purpose described above, gas lasers such as helium-neon, argon gas and helium cadmium have been employed. However, disadvantages of these lasers are that they are too expensive, large and short life. Although a method using a semiconductor laser and a non-linear optical element is known, there were also problems with this method such that its conversion efficiency was insufficient and light with a wavelength suitable for silver halide photographic materials was not available, so that its practical application was not achieved. However, the use of a semiconductor laser and a silver halide infrared-sensitive photographic material makes it possible to readily obtain images using a low-priced compact exposure apparatus.

However, it is generally known that in cases when a silver halide emulsion is spectrally sensitized with an infrared-sensitizing dye, the dye becomes highly unstable in the emulsion, due to its specific structure, producing problems such as increased fogging in spectral sensitization.

To restrain fogging of emulsions, a technique of varying the pAg or the temperature at the time of chemical sensitization is disclosed in JP-A 58-125612 (herein, the term, JP-A means an examined, published Japanese Patent Application). However, this is a technique in chemical sensitization, not a technique for infrared spectral sensitization. JP-A 5-80445 discloses a technique of spectral sensitization, in which a sensitizing dye is added and then the temperature is raised. Thus, the sensitizing dye is added at a temperature 25 to 55° C. and chemical ripening is conducted at a still higher temperature, thereby producing a silver halide emulsion exhibiting superior linearity in the region of from intermediate to high densities. However, there is disclosed nothing with respect to problems concerning specific fogging of a infrared sensitizing dye. Further, the sensitizing dye was added before starting chemical sensitization.

In view of the foregoing, there is continuous strong desire for a technique for achieving reduced fog and enhanced sensitivity, even when subjecting a silver halide emulsion to infrared spectral sensitization.

SUMMARY OF THE INVENTION

Accordingly, an object of the present invention is to provide a silver halide emulsion with reduced fog, even when subjected to infrared spectral sensitization and a silver halide light sensitive photographic material by use thereof.

The above-described object of the invention can be accomplished by the following constitution:

(1) a method of preparing a silver halide emulsion comprising silver halide grains, the method comprising the steps of:
  (i) forming a silver halide emulsion,
  (ii) subjecting the silver halide emulsion to chemical sensitization, and
  (iii) adding a sensitizing dye the silver halide emulsion, wherein the sensitizing dye exhibits an absorption maximum at a wavelength of not less than 730 nm, the pAg of the emulsion being adjusted to a range of from 7.50 to 8.25 after starting the chemical sensitization and before adding said sensitizing dye; and (2) a silver halide light sensitive photographic material, comprising a support having thereon a silver halide emulsion layer comprising a silver halide emulsion containing a sensitizing dye exhibiting an absorption maximum at the wavelength of not less than 730 nm (hereinafter, also denoted as $\lambda max \geqq 730$ nm) and which has been chemically sensitized, wherein the pAg of the emulsion is adjusted to 7.50 to 8.25 at the time after starting chemical sensitization and before adding the sensitizing dye.

DETAILED DESCRIPTION OF THE INVENTION

Silver halide emulsions relating to the invention are those which are chemically sensitized and are further spectrally sensitized with a sensitizing dye exhibiting an absorption maximum ($\lambda max$) at a wavelength of not less than 730 nm.

The process of preparing a silver halide emulsion generally comprises various stages, including silver halide grain formation, chemical sensitization and spectral sensitization step, and chemical sensitization-stopping. In the silver halide formation stage, an aqueous silver salt solution and an aqueous halide salt solution are conventionally added into a protective colloid solution such as gelatin to form nucleus grains and the formed nucleus grains are allowed to grow to silver halide grains with desired sizes. In the final step of this stage, excessive soluble salts are removed or the temperature is lowered to reduce variation of the form or size of silver halide grains.

In the conventional subsequent stage, chemical sensitization is conducted, in which an additive, so-called chemical sensitizer is added to a silver halide emulsion maintained at a high temperature to allow chemical sensitization to start. Further, a sensitizing dye is added to the emulsion to allow spectral sensitization to start. The chemical sensitization and the spectral sensitization may not be separated to two steps. For example, to a silver halide emulsion which has completed the grain formation stage, a sensitizing dye is added, then, sodium thiosulfate and chloroauric acid are further added thereto to perform chemical sensitization, as described in Example 1 of JP-A 5-80445.

One feature of the silver halide emulsion used in the invention is that after the start of chemical sensitization, a sensitizing dye having a λmax of 730 nm or more is added. Before adding the dye, various specified compound(s) are added and characteristic values of the emulsion are adjusted to a specified region. According the invention, a silver halide emulsion with a high sensitivity can be obtained without causing an increase of fog which occurred in infrared-sensitive emulsion.

One embodiment of obtaining silver halide emulsion used in the invention concerns adjusting the pAg to 7.5 to 8.25 prior to addition of the sensitizing dye. The pAg is preferably 7.58 to 8.15, and more preferably 7.65 to 8.10. The pAg can be adjusted using any compound, preferably using a halide salt such as sodium chloride, potassium chloride, sodium bromide, potassium bromide, ammonium bromide or potassium iodide, and more preferably using a chloride salt such as sodium chloride.

One preferred embodiment of obtaining the silver halide emulsion used in the invention concerns addition of a mercapto compound prior to addition of the sensitizing dye. Any of commonly known mercapto compounds can be employed, and a preferred compound is represented by the following formula (I) or (II):

(I)

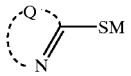

(II)

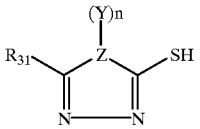

In formula (I), Q is an atomic group necessary to form a 5-membered heterocyclic ring, which may be substituted or condensed with a benzene ring; M is a hydrogen atom, an alkali metal atom or an ammonium group. Examples of the 5-membered heterocyclic ring formed by the Q of formula (I) include a imidazole ring, triazole ring, tetrazole ring, thiazole ring, oxazole ring, selenazole ring, benzimidazole ring, naphthoimidazole ring, benzothiazole ring, naphthothiazole ring, benzoselenazole ring, and benzoxazole ring. Examples of a substituent onto the heterocyclic ring include a lower alkyl group, alkoxy group, aryl group, sulfonyl group, carbonyl group, carboxy group, sulfonic acid group, carboxyl group, sulfonic acid group, carbamoyl group, sulfonamido group, carbamido group and heterocyclic group.

In formuls (II), Y is a hydrogen atom, amino group, alkyl group, alkenyl group, cycloalkyl group, aryl group, —CONHR$^{32}$, —COR$^{33}$, —NHCOR$^{34}$, or —NHSO$_2$R$^{34}$; Z is a nitrogen atom, sulfur atom, or oxygen atom; n is 1 when Z is nitrogen, and 0 when Z is oxygen or sulfur; R31 is a hydrogen atom, amino group, alkyl group, alkenyl group, hydroxy, hydrazino group, aryl group, cycloalkyl group, mercapto group, —NHCOR$^{35}$, —NHSO$_2$R$^{35}$, or —SR$^{36}$, in which R$^{32}$, R$^{33}$, R$^{34}$ R$^{35}$ and R$^{36}$ each are an alkyl group, alkenyl group, cycloalkyl group or aryl group.

Exemplary examples of the mercapto compound are shown below but the compound is not limitd to these.

ME-1

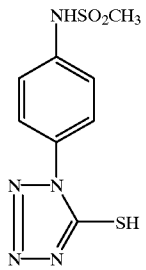

ME-2

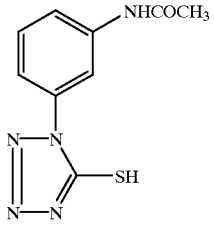

ME-3

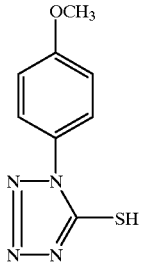

ME-4

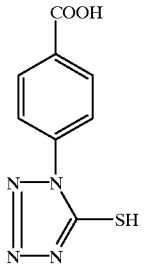

-continued

ME-5

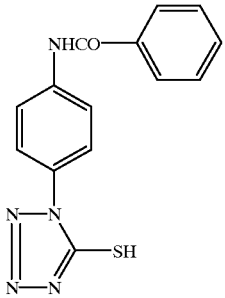

ME-6

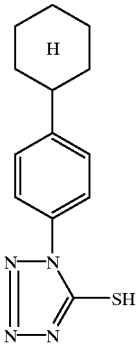

ME-7

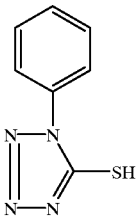

ME-8

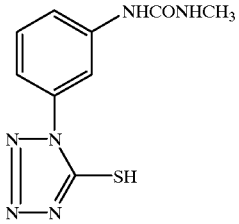

ME-9

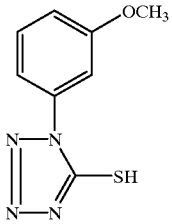

-continued

ME-10

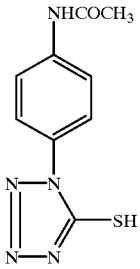

ME-11

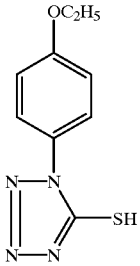

ME-12

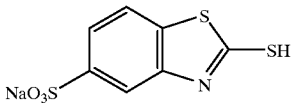

ME-13

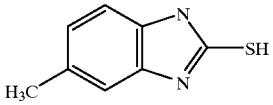

Of the compounds represented by formula (I) or (II), mercaptotetrazole compounds such as ME-1 to ME-11 are specifically preferred. The mercapto compound is incorporated preferably in an amount of 1×10−6 to 1×10−2 mole, and more preferably 1×10−5 to 1×10−3 mole per mole of silver halide.

Deflocculating agents usable in the invention include commonly known deflocculating agents, as described in JP-A 63-55544 at page 4, right upper column to left lower column. Examples of the preferred deflocculating agents usable in the invention are shown below but are not limited to these.

d-1

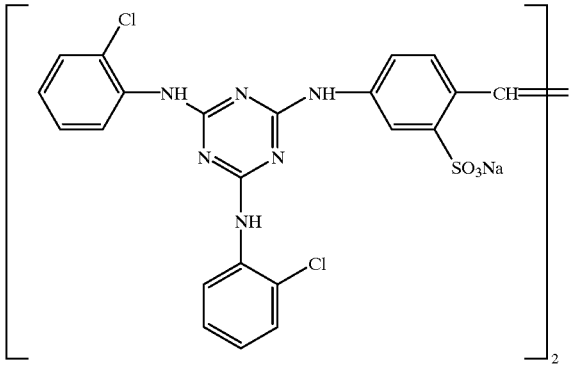

-continued d-2

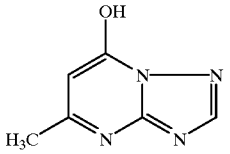

d-3

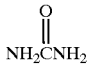

d-4

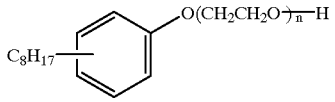

d-5

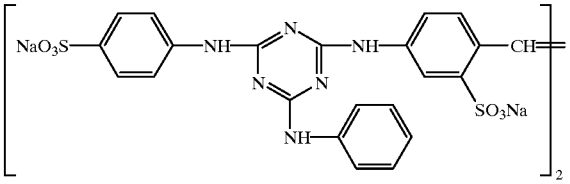

d-6

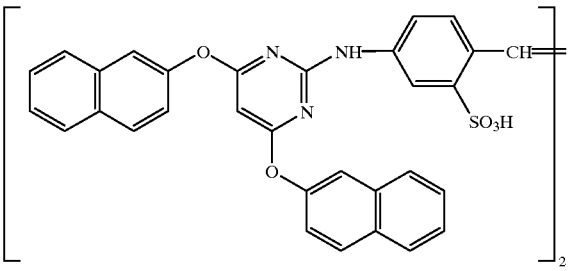

d-7

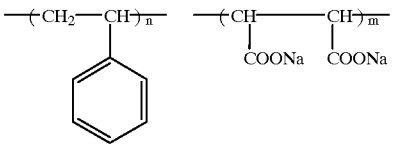

n:m = 50:50

Mw = 300,000

(Mw = Weight average molecular weight)

d-8

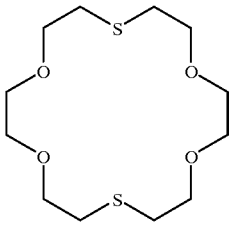

-continued d-9

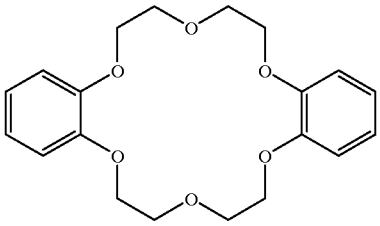

Other useful deflocculating agents include surfactant p-octylphenyl-$(OCH_2CH_2)_{34}OH$, $C_{12}H_{25}OSO_3Na$, and various kinds of crown ethers. Further, exemplary examples of the deflocculating agents and explanation of the compounds are described in Hertz, Photo. Sci. Eng. 18, 323–335 (May/June 1974).

In one embodiment of obtaining silver halide emulsions used in the invention, the pH is preferably adjusted to 4.9 to 7.5 (and more preferably 4.9 6.9) prior to addition of a sensitizing dye. The pH can be adjusted by using any compound and preferably using organic or inorganic acids such as sulfuric acid, nitric acid, acetic acid, succininc acid and citric acid; sodium hydroxide, potassium hydroxide and sodium carbonate.

One feature of the silver halide emulsion used in the invention is characterized in that after starting chemical sensitization of the silver halide emulsion, a sensitizing dye having an absorption maximum (λmax) at a wavelength of 730 nm or longer (hereinafter, also denoted as λmax≧730 nm) is added to the emulsion and a tf value after adding the sensitizing dye is a specified value. In one embodiment of the invention, after adding the sensitizing dye, the tf value is preferably not more than $3.7\times10^{-12}$ under the condition at a temperature of 10° C. or higher; in another embodiment of the invention, after adding the sensitizing dye, the tf value is preferably $2.6\times10^{-13}$ to $9.5\times10^{-11}$ under the condition at a temperature of lower than 10° C. The tf value is defined as follows:

$$tf=\int \exp(-K/T)dt$$

where t is a time (min.); K is a constant value 1.006×106; and T is a temperature in terms of absolute temperature of an environment in which the emulsion is placed.

The tf value represents a value expecting a thermal effect at a given temperature and it was proved that this value had a correspondence to variation in performance of a silver halide emulsion. In the formula described above, the integral does not extend beyond the time when the silver halide emulsion is coated and becomes a silver halide photographic material. After adding the sensitizing dye to the emulsion, the tf value under the condition of a temperature of 10° C. or higher is preferably not more than $3.7\times10^{-12}$, and more preferably not more than $1.2\times10^{-12}$. In cases when the tf is more than $3.7\times10^{-12}$, performance of the silver halide photographic material tends to fluctuate and sensitivity is reduced. In another embodiment, after adding the sensitizing dye to the emulsion, the tf value under the condition of a temperature of lower than 10° C. is preferably not more than $2.6\times10^{-13}$ to $9.5\times10^{-11}$, and more preferably $2.6\times10^{-13}$ to $4.7\times10^{-11}$. In cases when the tf is more than these values, performance of the silver halide photographic material tends to fluctuate and sensitivity is reduced.

One preferred embodiment of the silver halide emulsion used in the invention is a silver halide emulsion comprised of silver halide grains containing 95 mol % or more chloride, including silver chloride, silver bromochloride, silver iodo bromochloride and silver iodochloride. Particularly are preferred silver bromochloride containing 95 mol & or more chloride, and specifically, those having a high bromide containing phase within the grain are preferred. Silver iodochloride grains having grains which contain 0.05 to 0.5 mol % iodide in the vicinity of the grain surface are also preferred. The high bromide-containing phase of the silver bromochloride grains may be so-called core/shell type or a region forming so-called epitaxy junction in which two or more portions different in halide composition are exist. The high bromide-containing phase is preferably at the corners of the crystal grains. The halide composition may be varied continuously or non-continuously.

It is advantageous that silver halide emulsion grains used in the invention are allowed to contain a heavy metal ion to thereby achieve improvements in reciprocity law failure characteristics such as prevention of desensitization at high intensity exposure or prevention of reduction in contrast in a shadow portion. Preferred heavy metal ions include 8th to 10th group metals such as iron, iridium, platinum, palladium, nickel, rhodium, osmium, ruthenium, and cobalt; $12^{th}$ group metals such as cadmium, zinc, and mercury; lead; rhenium; molybdenum; tungsten; gallium; and chromium. Of these are preferred metal ions of iron, iridium, platinum, ruthenium, gallium and osmium. The metal ion can be added to the emulsion in the form of a salt or a complex salt. In cases where the heavy metal ion is in the form of a complex salt, examples of ligands include a cyanide ion, thiocyanate ion, isothiocyanate ion, cyanate ion, chloride ion, bromide ion, iodide ion, carbonyl and ammonia. Of these are preferred cyanide ion, thiocyanate ion, isothiocyanate ion, chloride ion and bromide ion. To allow silver halide grains to contain heavy metal ions, a heavy metal compound may be added at any time before or during silver halide grain formation; or after grain formation and during physical ripening. The heavy metal compound may be dissolved together with a halide and added overall or at a time during grain formation. Alternatively, fine silver halide grains containing a heavy metal ion which have been prepared in advance, may be added. The heavy metal ion to be added to the emulsion is preferably $1\times10^{-9}$ to $1\times10^{-2}$ mole per mole of silver halide, and more preferably $1\times10^{-8}$ to $1\times10^{-5}$ mole per mole of silver halide.

Silver halide grains used in the invention mat be any form. One preferred grains are cubic grains having a (100) face. Further, according to the methods described in U.S. Pat. Nos. 4,183,756, and 4,225,666; JP-A55-26589; JP-B 55-42737 (herein, the term, JP-B means published Japanese Patent); and J. Photogr. Sci 21, 39 (1973), octahedral, tetradecahedral or dodecahedral grains can be prepared and employed. Furthermore, grains having twin plane(s) can be employed.

Silver halide grains used in the invention are preferably those having a single form, and it is preferred that two or more kinds of monodisperse grains are incorporated into a layer. The grain size is nit specifically limited but preferably 0.1 to 1.2 $\mu$m, and more preferably 0.2 to 1.0 $\mu$m in terms of rapid processability, sensitivity and other photographic performance. The grain size can be determined using the grain projected area or diameter approximation. In cases where the grains are substantially homogeneous in form, the grain size distribution can be fairly exactly represented based on the diameter or area. With regard to the grain size distribution of silver halide grains, a monodisperse grains having a variation coefficient of the grain size of not more than 0.22, and more preferably not more than 0.15 are preferred. Specifically, it is preferred that two or more monodisperse grain emulsions having a variation coefficient of not more than 0.15 are incorporated into a layer. The variation coefficient is a coefficient representing a width of the grain size distribution, which is defined as below:

$$\text{Variation Coefficient}=S/R$$

Where S is a standard deviation of grain size, and R is an average size.

There are applicable preparation apparatus of silver halide emulsions and preparation method thereof commonly known in the art. The emulsions used in the invention include an acid emulsion, neutral emulsion and ammoniacal emulsion. Silver halide grains may be those which are prepared through one step or those which are obtained by forming seed grains and allowing the formed seed grains to grow. In this case, the method for preparing the seed grains and the method for growing the seed grains may the same with or different from each other. The mode of reacting a soluble silver salt with a soluble halide salt includes normal precipitation, reverse precipitation, double jet precipitation and a combination thereof. Of these, the double jet precipitation is preferably and the pAg-controlled double jet method described in JP-A 54-4851 is applicable as one mode of the double jet precipitation. Further, there may be employed an apparatus described in JP-A 57-92523 and 57-92524, in which aqueous silver salt and halide solutions are supplied from an addition apparatus provided in reaction mother liquor; an apparatus described in German Patent 2921164, in which aqueous silver salt and halide solutions are continuously added with varying a concentration; and an apparatus described in JP-B 56-501776, in which grain formation is performed, while reaction mother liquor is taken out of a reaction vessel and subjected to ultrafiltration to concentrate it. Furthermore, silver halide solvents such as thioethers may be optionally used. Compounds including a mercapto group containing compound, a nitrogen containing heterocyclic compound and a sensitizing dye may be added during grain formation or after completing grain formation.

The silver halide emulsion used in the invention is chemically sensitized and spectrally sensitized with a sensitizing dye having an absorption maximum at a wavelength of 730 nm or more (i.e., $\lambda max \geqq 730$ nm). The silver halide emulsion may be chemically sensitized by a combination of a sensitization method by use of a gold compound and a sensitization method by use of a chalcogen sensitizer. The chalcogen sensitizer includes a sulfur sensitizer, selenium sensitizer and tellurium sensitizer, and the sulfur sensitizer is preferably used. Examples of the sulfur sensitizer include thiosulfates, allylthiocarbamidothiourea, allylisothiocyanate, cystine, p-toluenethiosulfonic acid salt, rhodanine and inorganic sulfur (or sulfur single substance). The amount of the sulfur sensitizer to be added, depending on the kind thereof or expected effects, is preferably $5\times10^{-10}$ to $5\times10^{-5}$ mole, and more preferably $5\times10^{-8}$ to $3\times10^{-5}$ mole per mole of silver halide. The gold sensitizer such as chloroauric acid or gold sulfide may be added in the form of its complex. Examples of a ligand compound include dimethylrhodanine, thicyanic acid, mercaptotetrazole, and mercaptotriazole. The amount of the gold sensitizer to be added, depending on the kind thereof or ripening conditions, is preferably $1\times10^{-8}$ to $1\times10^{-4}$ mole, and more preferably $1\times10^{-8}$ to $1\times10^{-5}$ mole per mole of silver halide. The silver halide emulsion may be subjected to reduction sensitization.

In the silver halide emulsion used in the invention, commonly known antifoggants and stabilizers may be used to prevent fogging produced during the course of preparing silver halide photographic materials, reduce variation in performance during storage and restrain fogging during development. The mercapto compounds afore-mentioned can be used for the purpose-described above. These compounds may be incorporated at any time of the stage of grain formation or chemical sensitization, after completing chemical sensitization or of the stage of preparing a coating solution. In cases where chemical sensitization is performed in the presence of the mercapto compound, the compound to be used is preferably $1\times10^{-5}$ to $5\times10^{-4}$ mole per mole of silver halide. In cases where being added after completing chemical sensitization, the compound to be added is preferably 1×10−6 to $1\times10^{-2}$ mole, and more preferably $1\times10^{-5}$ to $5\times10^{-3}$ mole per mole of silver halide. In cases where being added to a silver halide emulsion layer in the stage of preparing a coating solution, the compound to be added is preferably $1\times10^{-6}$ to $1\times10^{-1}$ mole, and more preferably $1\times10^{-5}$ to $1\times10^{-3}$ mole per mole of silver halide. In case where added to a layer other than the silver halide emulsion layer, the amount to be contained in the layer is preferably $1\times10^{-9}$ to $1\times10^{-13}$ mole per $m^2$.

Dyes having absorption in the various wavelength region may be employed for the purpose of anti irradiation or antihalation. Commonly known compounds are employed as the dyes, specifically, dyes A1 to A11 described in JP-A 3-251840 and dyes described in JP-A 6-3770 are preferably used as a dye having absorption in the visible region. Further, a compound represented by the following general formula is preferably used as an infrared absorbing dye:

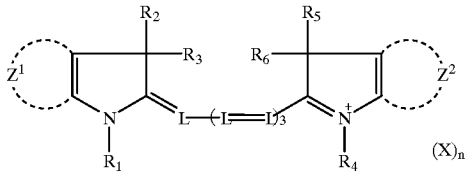

wherein $R^1$ to $R^6$ each are a hydrogen atom, an aliphatic group, aromatic group or heterocyclic group; L is a substituted or unsubstituted methine group; X is a cation; n is 0 or a positive integer necessary to neutralize positive ion charge; $Z^1$ and $Z^2$ each are a substituted or unsubstituted condensed ring, provided that at least three acid group are contained in $Z^1$, $Z^2$, $R^1$ to $R^6$ and L.

The silver halide photographic material used relating to the invention preferably has at least a hydrophilic colloid layer which is tinted with a ballasted colorant, at the side nearer than a silver halide emulsion layer nearest to the support. The colorants usable in the invention include dyes and other organic or inorganic colorants. In this regard, dyes in the form of a fine solid particle dispersion can be used. The compound represented by the following formula can be cited as a compound usable as the solid particle dispersion dye:

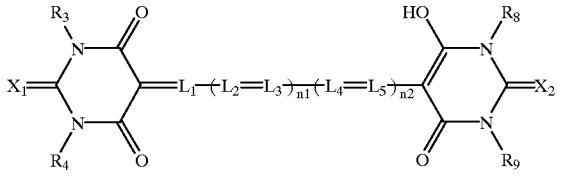

wherein $R_3$, $R_4$, R8 and $R_9$ each are a hydrogen atom, an alkyl group, alkenyl group, cycloalkyl group, aryl group or heterocyclic group; $L_1$ to $L_5$ each are a methine chain; nl and n2 each are an integer of 0 to 1; and $X_1$ and $X_2$ each are a oxygen atom or sulfur atom.

Preferred inorganic compounds include colloidal silver and colloidal manganese, and colloidal silver is more preferred. Colloidal metal, which is capable of being decolorlized in processing solution, is usable in the photographic material relating to the invention. The amount of the colloidal silver to be used, depending on the form of silver or the purpose of the use, is preferably 0.01 to 0.3 $g/m^2$, and more preferably 0.02 to 0.1 $g/m^2$. The excessive coverage produces problems such as yellowish white background, and in cases of the insufficient coverage, load on the colorant such as a dye becomes larger, producing problems such as residual dye stain. The colloidal silver, for example, gray-colored colloidal silver can be obtained in such a manner that silver nitrate is reduced in an aqueous gelatin solution in the presence of a reducing agent such as hydroquinone, phenidone, ascorbic acid, pyrogallol or dextrin, while maintaining alkalinity, then neutralized, cooled to form gelled gelatin and thereafter a remained reducing agent and soluble salts are removed by noodle washing. When reduced under alkaline conditions, the reaction in the presence of an azaindene compound or a mercapto compound leads to a colloidal silver dispersion comprised of homogeneous particles.

The silver halide photographic material used in the invention may have a colored hydrophilic colloid layer containing a white pigment at the side nearer than a silver halide emulsion layer provided nearest to the support. Preferred examples of the pigment include rutile-type titanium dioxide, anatase-type titanium dioxide, barium sulfate, barium stearate, silica, alumina, zirconium oxide and kaoline. Of these, titanium dioxide is preferred. The white pigment is dispersed in an aqueous solution of hydrophilic colloid such as gelatin so that processing solution is permeable thereinto. The coating amount of the white pigment is preferably 0.1 $/m^2$ to 50 $g/m^2$, and more preferably 0.2 $/m^2$ to 5 $g/m^2$. The average primary particle size is preferably 0.32 to 1.0 μm, and more preferably 0.32 to 1.0 μm. Herein the average primary particle size is defined as a cube root of a grain volume that gives a maximum value of a product of the grain volume and its frequency, from electron microscopic observation. The white pigment may be used alone or in the form of a mixture of plural pigments. In cases where used in combination of plural pigments different in average size, the average primary particle size of the mixture may be 0.30 μm or more, or the average primary particle size of any one of the pigments before being mixed may be 0.30 μm or more. The hydrophilic layer containing a pigment is provided between a support and a silver halide emulsion layer provided closest to the support. Further, a sublayer on the support or a light-insensitive hydrophilic colloid layer such as an interlayer may be provided between the support and a silver halide emulsion layer provided closest to the support. It is also preferred in terms of enhancement of sharpness that an light absorbing substance capable of preventing halation caused by the support or the white pigment, such as colloidal silver, aqueous soluble dyes and dyes in the form of a solid particle dispersion, is allowed to be incorporated into the hydrophilic white pigment layer.

A brightening agent may be preferably incorporated into the silver halide photographic material used in the invention to improve whiteness of the background. Examples thereof include compounds represented by general formula II described in JP-A 2-232652.

The silver halide emulsion used in the invention is chemically sensitized and further spectrally sensitized with a sensitizing dye having an absorption maximum at the wavelengths of 730 nm or longer (i.e., $\lambda \geqq 730$ nm). The sensitizing dye having an absorption maximum at the wavelengths of 730 nm or longer is preferably represented by the following formula (IRS):

Formula (IRS-1)

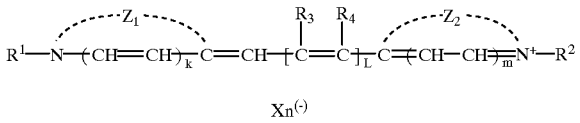

In the formula, $Z_1$ and $Z_2$ each represent an atomic group necessary to form a heterocyclic ring. The heterocyclic ring a 5- or 6-membered ring containing a nitrogen atom, an oxygen atom, selenium atom or tellurium atom, and the ring may be a condensed ring, which may be substituted. Examples of the heterocyclic ring include thiazole, benzothiazole, naphthothiazole, selenazole, benzoselenazole, naphthoselenazole, oxazole, benzoxazole, naphthoxazole, imidazole, benzoimidazole, naphthoimidazole, 4-quinoline, pyrroline, pyridine, tetrazole, indolenine, benzoindolenine, indole, tellurazole, benzotllurazole and naphtotellurazole. $R^1$ and $R^2$ each represent an alkyl group, an alkenyl group, an alkynyl group or an aralkyl group, each of which may be substituted. The alkyl group is preferably a straight-chained, branched or cyclic one having 1 to 8 carbon atoms.

Substituents for the alkyl group include a halogen atom (e.g., bromine, chlorine, fluorine, etc.), hydroxy, a cyano, an alkoxy group, substituted or unsubstituted amino group, carboxylic acid, and sulfonic acid. Examples of the alkenyl group include vinylmethyl, and examples of the aralkyl group include benzyl or phenethyl group. $R^3$ and $R^4$ represents a hydrogen atom, a lower alkyl group, an aralkyl group, provided that when $R^3$ is hydrogen, $R^4$ may be linked with another $R^4$ or $R^2$ to form a 5- or 6-membered heterocyclic ring, and when $R^4$ is hydrogen, $R^3$ may be linked with another $R^3$ to form a hydrocarbon ring or a heterocyclic ring.

L is an integer of 3 or more; k and m are 0 or 1; x is an acid anion; and n is 0 or 1.

Of the compounds represented by formula (IRS-1), a compound represented by the following formuls (IRS-2) or (IRS-3) is more preferred:

Formula (IRS-2)

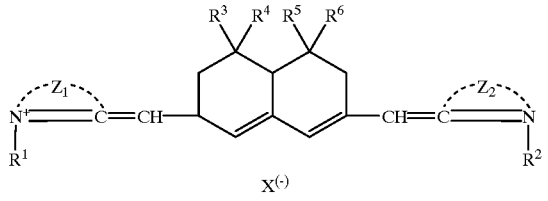

In the formula, $Z_1$ and $Z_2$ each represent an atomic group necessary to form a 5- or 6-membered heterocyclic ring, which may be substituted; $R^1$ and $R^2$ each represent an alkyl group or an aryl group, which may be substituted. $R^3$, $R^4$, $R^5$ and $R^6$ each represent a hydrogen atom, a substituted or unsubstituted alkyl group, or substituted or unsubstituted aryl group; x represents a counter ion.

Formula (IRS-3)

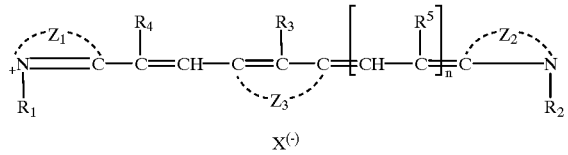

n = 0 or 1

In the formula, $Z_1$ and $Z_2$ each represent an atomic group necessary to form a ring such as thiazole, oxazole, selenazole, pyridine, quinoline and tellurazole rings, which may be substituted; $Z_3$ represents an atomic group necessary to form a 5- or 6-membered carbon ring; $R^1$ and $R^2$ each represent substituted or unsubstituted alkyl group, substituted or unsubstituted aryl group, provided that $R^1$ and $R^4$, or $R^2$ and $R^5$ mat be combined with each other to form a ring; $R^3$ presents a hydrogen atom, substituted or unsubstituted alkyl group, substituted, unsubstituted aryl group or a heterocyclic group, which may be substituted; x is a counter ion; n is 1 and one of $Z_1$ and $Z_2$ is preferably a thiazole nucleus and the other is preferably a thiazole or oxazole nucleus.

Exemplary examples of the sensitizing dye having an absorption maximum at a wavelength of 730 nm or longer are shown below but are not limited to these examples.

IS-1

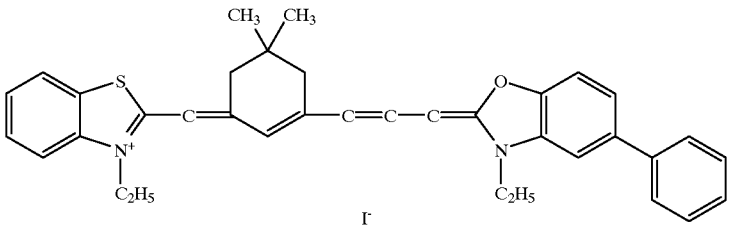

-continued
IS-2
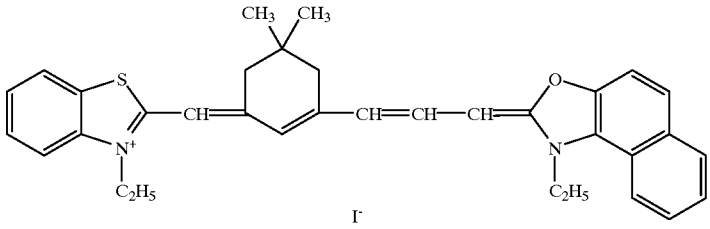
IS-3
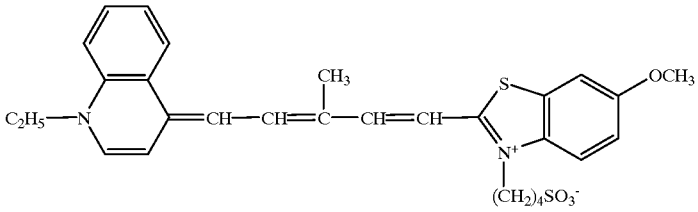
IS-4
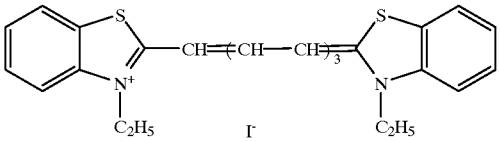
IS-5
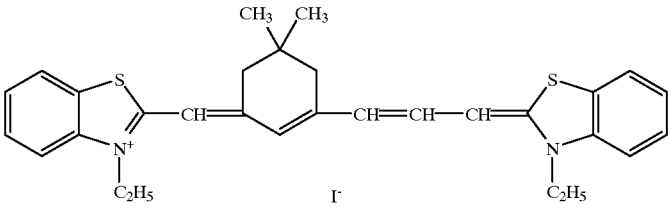
IS-6
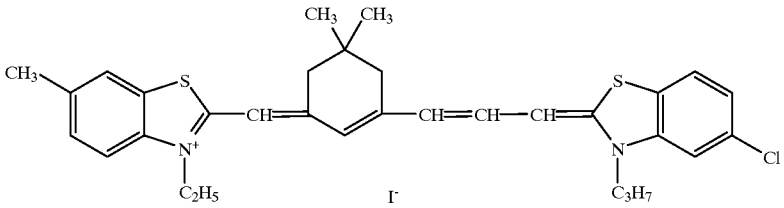
IS-7
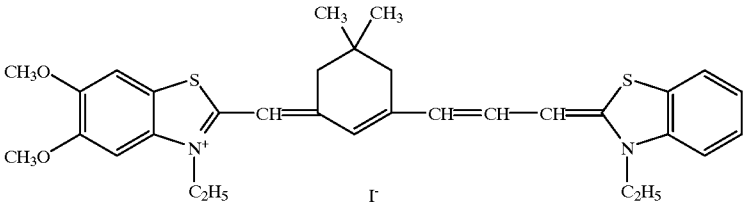
IS-8
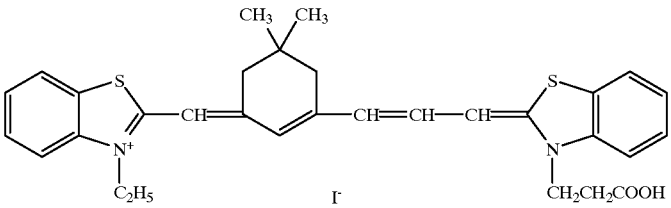

-continued
IS-9
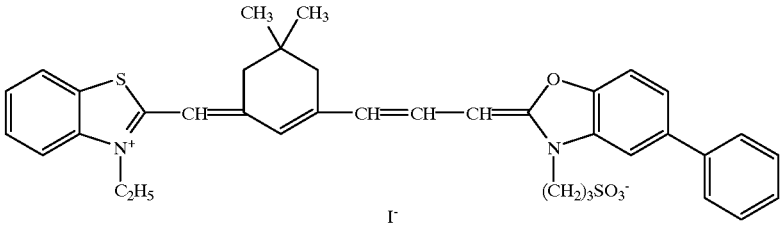
IS-10
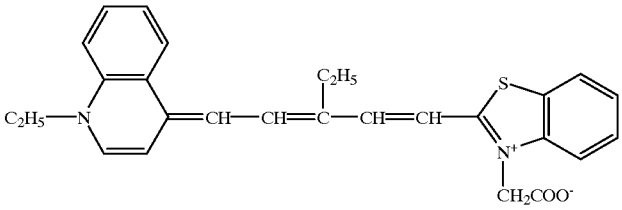
IS-11
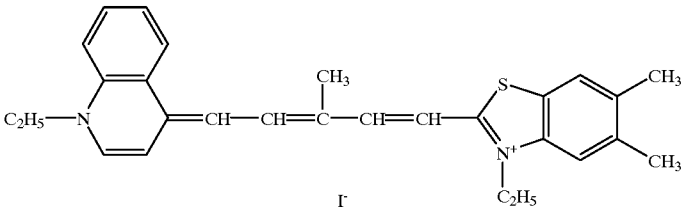
IS-12
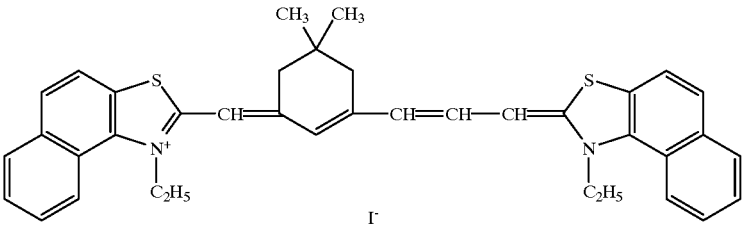
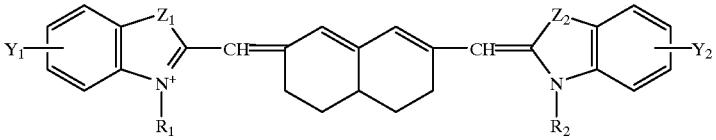
| No. | $Z_1$ | $Z_2$ | $R_1$ | $R_2$ | $Y_1$ | $Y_2$ | $X^-$ |
|---|---|---|---|---|---|---|---|
| IS-13 | S | O | $C_2H_5$ | $CH_3$ | H | H | I |
| IS-14 | S | O | $C_2H_5$ | $C_2H_5$ | H | 4,5-benzo | I |
| IS-15 | S | O | $C_2H_5$ | $C_2H_5$ | 6-$CH_3$ | 6-$CH_3$ | I |
| IS-16 | S | O | $C_2H_5$ | $C_2H_5$ | 5-$OCH_3$ | 6-$CH_3$ | I |
| IS-17 | O | O | $C_2H_5$ | $C_2H_5$ | H | H | I |
| IS-18 | O | O | $C_2H_5$ | $C_2H_5$ | 5,6-benzo | 5,6-benzo | I |
| IS-19 | S | S | $CH_3$ | $CH_3$ | 5-$SCH_3$ | 5-$SCH_3$ | I |
IS-20
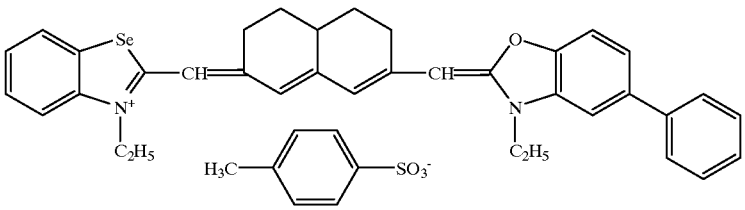

-continued

IS-21

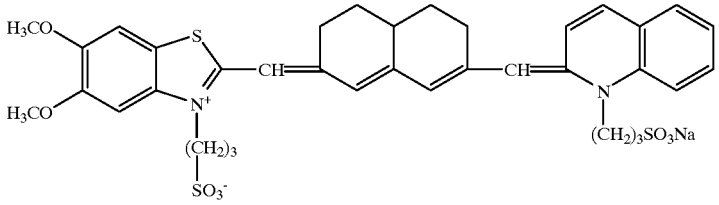

IS-22

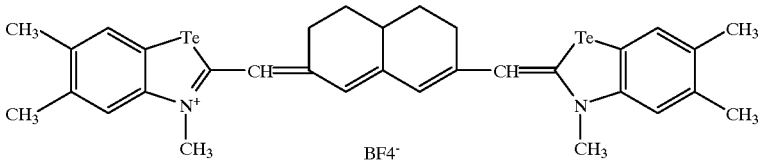

IS-23

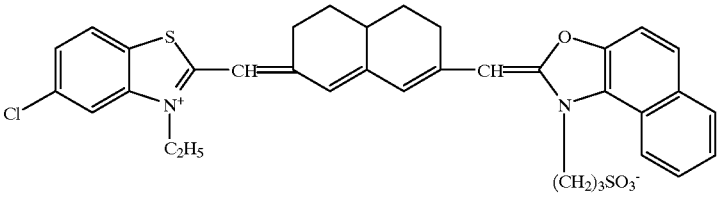

IS-24

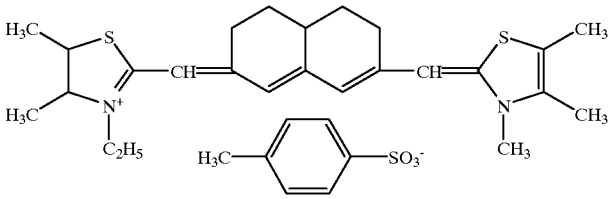

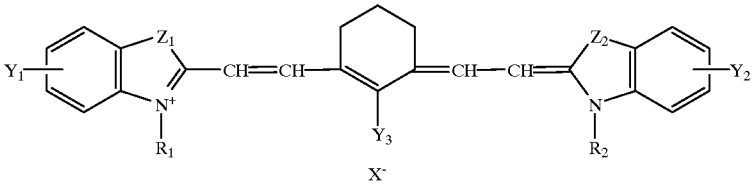

| No. | $Z_1$ | $Z_2$ | $R_1$ | $R_2$ |
|---|---|---|---|---|
| IS-25 | S | S | $C_2H_5$ | $C_2H_5$ |
| IS-26 | S | S | $C_2H_5$ | $C_2H_5$ |
| IS-27 | S | S | $C_2H_5$ | $C_2H_5$ |
| IS-28 | O | O | $CH_3$ | $CH_3$ |
| IS-29 | Te | Te | $C_2H_5$ | $C_2H_5$ |
| IS-30 | Se | Se | $C_2H_5$ | $C_2H_5$ |
| IS-31 | S | S | $C_2H_5$ | $C_2H_5$ |
| IS-32 | O | O | $(CH_2)_3SO_3^-$ | $(CH_2)_3SO_3Na$ |

| No. | $Y_1$ | $Y_2$ | $Y_3$ | $X^-$ |
|---|---|---|---|---|
| IS-25 | $5,6SCH_3$ | $5,6SCH_3$ | $CH_3$ | $BF_4$ |
| IS-26 | 6,7-benzo | 6,7-benzo | $C_2H_5$ | $BF_4$ |
| IS-27 | H | H | H | $BF_4$ |
| IS-28 | H | H | $C_2H_5$ | $CF_3SO_3$ |
| IS-29 | H | H | $CH_3$ | $BF_4$ |
| IS-30 | $6\text{-}OCH_3$ | $6\text{-}OCH_3$ | $CH_3$ | $BF_4$ |
| IS-31 | $5,6\text{-}OCH_3$ | $5,6\text{-}OCH_3$ | $CH_3$ | $BF_6$ |
| IS-32 | 6,7-benzo | 6,7-benzo | $CH_3$ | — |

-continued

IS-33

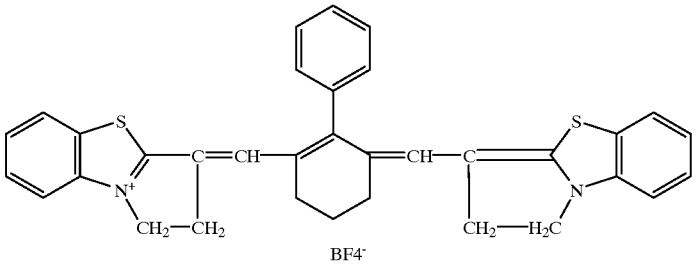

IS-34

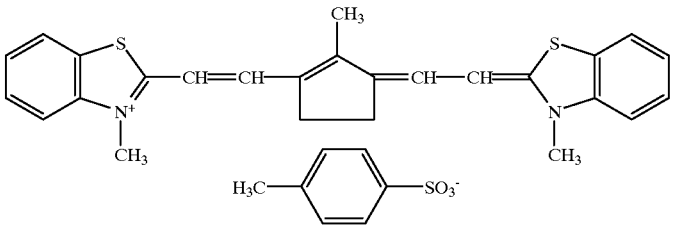

IS-35

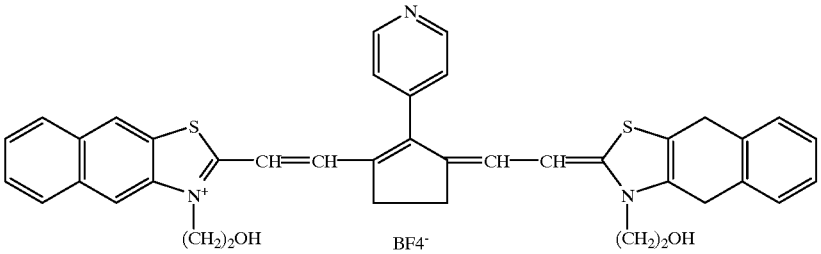

IS-36

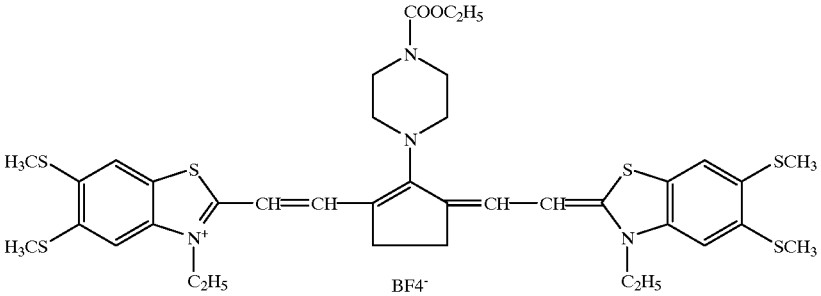

Of the sensitizing dye having an absorption maximum at a wavelength of 730 nm or longer, cyanine type sensitizing dyes are preferred, specifically, dicarbocyanine dyes having a 4-quinoline nucleus and tricarbocyanine dyes having an oxazole or thiazole nucleus are preferred. The sensitizing dye having an absorption maximum at a wavelength of 730 nm or longer can be readily synthesized by the commonly known methods, for example, by the method described in F. M. Hammer, The Chemistry of Heterocyclic Compounds, Vol. 18, The cyanine Dyes and Related compounds (published Interscience, New York, 1964). The photographic material relating to the invention may have layer(s) containing a silver halide emulsion sensitized to a specific region of 400 to 900 nm, in combination with a yellow coupler, a magenta coupler and a cyan coupler. The silver halide emulsion may be combined with a single sensitizing dye or plural sensitizing dyes.

The sensitizing dye may be incorporated through solution in water or a water-miscible organic solvent such as methanol, ethanol, fluoroalcohol, or dimethylformamide; or incorporated in the form of suspension without completely dissolving. Examples of a dispersion apparatus for preparing such suspension include a ball mil, sand mill and an ultrasonic homogenizer as well as a high-speed stirring dispersion machine described in JP-A 4-125631. As described in JP-A 4-125632, after subjecting to pre-treatment such as dry-processed pulverization, wet-processed dispersion may be conducted using the dispersion apparatus described above.

In silver halide photographic materials relating to the invention, at least three of ultraviolet-sensitive, blue-sensitive, green-sensitive, red-sensitive and infrared-sensitive emulsions are preferably used, and at least one of the three emulsions is an infrared-sensitive emulsion having an absorption maximum at the wavelengths of 730 nm or longer. The use of a red-sensitive emulsion and an infrared-sensitive emulsion in the silver halide photographic material used in the invention is preferred in terms of selection of a light source.

Couplers usable in the invention include any compounds which are capable of forming a product having an absorption maximum at the wavelengths of 340 nm or longer upon coupling reaction with an oxidation product of a color developing agent. Representative examples thereof include a yellow coupler forming a yellow dye having an absorption maximum in the wavelength region of 350 to 500 nm, a magenta coupler forming a magenta dye having an absorption maximum in the wavelength region of 500 to 600 nm, and a cyan coupler forming a cyan dye having an absorption maximum in the wavelength region of 600 to 750 nm.

Preferred cyan couplers used in the invention include commonly known phenol type, naphthol type or imidazole type couplers. Exemplary examples thereof include phenol type couplers which are substituted by an alkyl group, acylamino group or ureido group, naphthol type couplers formed of a 5-aminonaphthol skeleton and two-equivalent naphthol type coupler introducing oxygen as a releasable group. Specifically, at least a cyan coupler represented by formula (c-1) or (C-2) is preferably contained:

Formula (C-1)

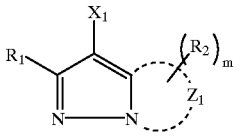

wherein $R_1$ is a hydrogen atom or a substituent; $R_2$ is a substituent; m is an integer of 0, 1 or 2, provided that when m is 0, $R_1$ is an electron-withdrawing group, when m is 1 or 2, at least one of $R_1$ and $R_2$ is an electron-withdrawing group, and when m is 2, m's may be the same with or different from each other; $Z_1$ a non-metal atomic group necessary to form a 5-membered nitrogen containing heterocyclic ring; $X_1$ is a hydrogen atom or a substituting group capable of being released upon reaction with an oxidation product of a developing agent;

Formula (C-2)

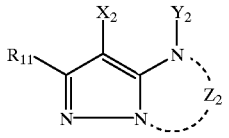

wherein $R_{11}$ and $Y_2$ each are a hydrogen atom or a substituent; $X_2$ is a hydrogen atom or a substituting group capable of being released upon reaction with an oxidation product of a developing agent; $Z_2$ is a non-metal atomic group necessary to form a 6-membered nitrogen containing heterocyclic ring together with —N($Y_2$)— and condensed with a pyrazole ring, which may be substituted or further condensed with a benzene ring. The cyan coupler described above is contained preferably in an amount of $1\times10^{-3}$ to 1 mole, and more preferably $1\times10^{-2}$ to $8\times10^{-1}$ mol per mole of silver halide. The cyan coupler may be used in combination with another kind of a cyan coupler.

Preferred magenta couplers usable in the photographic material used in the invention include a compound represented by general formula (M-1) described in JP-A 6-95283 at page 7, right column, which is superior in spectral absorption characteristics of the formed dye, including preferred exemplified compounds M-1 to M-19. Further, other exemplary examples include Compounds M-1 to M-61 described in European Patent 273712 at pages 6–21; and Compounds 1 to 223 described in European Patent 235913 at pages 36–92. The magenta coupler may be used in combination with another kind of a magenta coupler. The magenta coupler is contained preferably in an amount of $1\times10^{-3}$ to 1 mole, and more preferably $1\times10^{-2}$ to $8\times10^{-1}$ mol per mole of silver halide.

Preferred spectral absorption characteristics of magenta images of the photographic materials include λmax of 530 to 560 nm and λL.0.2 of 580 to 635 nm. The λmax and λL0.2 are defined as follows. When subjected to exposure and processing that substantially causes no color formation in the image forming layers other than the magenta image forming layer and gives magenta images of a maximum absorbance of 1.0 at the wavelengths of 500 to 600 nm, the wavelength giving an absorption peak is denoted as λmax and the wavelength giving an absorbance of 0.2 at the wavelengths longer than the λmax is denoted as λL0.2. In this case, the expression "substantially causes no color formation" means that a density at the maximum absorption wavelength is not more than 0.005.

In addition to the magenta coupler, an yellow coupler is also preferably incorporated into the magenta image forming layer. In this case, the difference in pKa between these couplers is preferably not more than 2 and more preferably not more than 1.5. Preferred examples of the yellow coupler include couplers represented by general formula (Y-Ia) described in JP-A 6-95283 at page 12, right column. Of these couplers, in cases where combined with a magenta coupler represented by formula (M-1), those which exhibit a pKa less by at least 3 than that of the combined magenta coupler, are preferred. Exemplary examples of such yellow couplers include Y-1 and Y-2 described in JP-A 6-95283 at pages 12–13, and (Y-1) to (Y-58) described in JP-A 2-139542 at pages 13–17. However, the yellow couplers are not limited to these.

Commonly known acetoanilide type yellow couplers are preferably used in the photographic materials used in the invention. Exemplary examples thereof include (Y-I-1) to (Y-I-55) described in JP-A 3-241345 at pages 5-9 and Y-1 to Y-30 described in JP-A 3-209466 at pages 11–14. There are also preferred coupler represented by formula (Y-I) described in JP-A 6-95283 at page 21. In the absorption spectrum of yellow images, the λmax is preferably not less than 425 and the λ0.2 is preferably not more than 515 nm. The λmax and λL0.2 are defined as follows. When subjected to exposure and processing that substantially causes no color formation in the image forming layers other than the yellow image forming layer and gives yellow images of a maximum absorbance of 1.0 at the wavelengths of 400 to 500 nm, the wavelength giving an absorption peak is denoted as λmax and the wavelength giving an absorbance of 0.2 at the wavelengths longer than the λmax is denoted as λL0.2. In this case, the expression "substantially causes no color formation" means that a density at the maximum absorption wavelength is not more than 0.005. The yellow coupler is contained preferably in an amount of $1\times10^{-3}$ to 1 mole, and more preferably $1\times10^{-2}$ to $8\times10^{-1}$ mol per mole of silver halide.

In cases when oil-in-water type emulsion dispersing method is employed to incorporate couplers or other organic compounds into the photographic material, they are dissolved in water-insoluble high boiling organic solvent having a boiling point of 150° or higher (and optionally in combination with low boiling and/or water-soluble organic solvent) and dispersed in hydrophilic binder such as an aqueous gelatin solution using a surfactant to form emulsion. Examples of dispersing means include a stirrer, homogenizer, colloid mill, flow jet mixer and ultrasonic homogenizer. The low boiling solvent may be removed after or simultaneously with dispersion. Preferred examples of the high boiling solvent used for dissolving and dispersing couplers include phthalic acid esters such as dioctyl phthalate, diisodecyl phthalate and dibutyl phthalate; and phosphoric acid esters such as tricresyl phosphate and trioctyl phosphate. The high boiling solvent preferably exhibits a dielectric constant of 3.5 to 7.0. The combined use of two or more kinds of high boiling solvents is also preferred.

In place of or in combination with the high boiling organic solvent, water-insoluble and organic solvent-soluble polymer compounds may be used, which may optionally be dissolved in a low boiling and/or water soluble organic solvent and are dispersed using various dispersing means to form emulsion. Examples of the water-insoluble and organic solvent-soluble polymer compounds include poly(N-t-butylacrylamide). Preferred surfactants used for dispersion of photographic additives and adjustment of surface tension at the time of coating include a compound having a hydrophobic group having 8 to 30 carbon atoms and a sulfonic acid group or its salt. Exemplary examples thereof include compounds A-1 to A-11 described in JP-A 64-26854. Fluoro-alkyl containing surfactants are also preferred. The thus obtained dispersion solution is usually incorporated into a coating solution containing a silver halide emulsion. The period of after dispersion and before incorporating in the coating solution and the period of after incorporating in the coating solution and until coating are preferably as short as possible, not longer than 10 hrs, more preferably not longer than 3 hrs, and still more preferably not longer than 20 min.

The couplers described above are preferably employed in combination with an anti-fading agent to prevent discoloration of color images caused by light, heat or humidity. Preferred examples thereof include phenyl ether compounds represented by formulas I and II described in JP-A 2-66541 at page 3; phenol compounds represented by formula IIIA described in JP-A 3-174150; amine compounds represented by formula A described in JP-A 64-90445; metal complex compounds represented by formulas XII, XIII, XIV and XV described in JP-A 62-182741, these which are suitable for magenta dyes. Compounds represented by formula I' described in JP-A 1-196049 and compounds represented by formula II described in JP-A 5-11417 are suitable for yellow and cyan dyes.

Compounds such as compound (d-11) described in JP-A 4-114154 at page 9, left lower column and compound (A'-1) described in ibid at page 10 left lower column are used to allow an absorption wavelength of a dye to shift. Further, fluorescent dye releasing compound described in U.S. Pat. No. 4,774,187 may also be used.

A compound capable of reacting with an oxidation product of a developing agent may be incorporated into an interlayer between photosensitive layers to prevent color mixing or staining, or into a silver halide emulsion layer to prevent fogging. Preferred examples of such compounds include hydroquinone derivatives (and more preferably, dialkylhydroquinones such as 2,5-di-t-octylhydroquinone. Specifically, compounds represented by formula II described in JP-A 4-133056 are preferred, including compounds II-1 to II-14 and compound 1 described in JP-A 4-133056 at page 13–14 and 17.

A UV absorbent is preferably incorporated in the photographic material to prevent static fogging or improve light fastness of dye images. The preferable UV absorber is benzotriazoles. The specifically preferable compounds are those represented by Formula III-3 in JP-A No. 1-250944, those represented by Formula III described in JP-A No. 64-66646, UV-1L through UV-27L described in JP-A No. 63-187240, those represented by Formula I described in JP-A No. 4-1633 and those represented by Formulas (I) and (II) described in JP-A No. 5-165144. In the photographic material used in the invention, gelatin is preferably used as a binder, and optionally used other types gelatin, gelatin derivatives, grat polymers of gelatin and other polymers, protein other than gelatin, saccharide derivatives, cellulose derivatives and synthetic polymer compounds including homopolymers and copolymers.

As a hardener for the binders, a vinylsulfone type hardener and a chlorotriazine type hardener are preferably used independently or two or more of them are used in combination. Compounds described in JP-A Nos. 61-249054 and 61-245153 are preferably employed. It is also preferable to add antiseptics and anti-mildew agents described in JP-A No. 3-157646 in a colloidal layer to prevent propagation of mildew and bacteria which adversely affect photographic performance and image storage stability. Further, lubricants and matting agents described in JP-A 6-118543 and 2-73250 may be incorporated in the photographic material or a protective layer to improve physical property after process.

Supports usable in the photographic materials used in the invention include paper covered with polyethylene or polyethylene terephthalate, paper made of natural pulp or synthetic pulp, polyvinyl chloride sheet, white pigment containing polypropylene or polyethylene terephthalate support and baryta paper. Specifically, supports having on both sides of raw paper water-proof resin cover layers are preferred. Preferred water proof resin include polyethylene and polyethylene terephthalate and their copolymers. The support having water proof resin on paper having a weight of 50 to 300 g/m$^2$ and smooth surface are usually employed. For the purpose of obtaining proof images, raw paper with not more than 130 g/m$^2$ (and specifically, not more than 70–120 g/m$^2$) is preferably used in terms of closeness in feeling at handling to print paper.

A support used in the photographic material preferably has a Taber stiffness of 0.8 to 4.0. The Taber stiffness can be measured by a rigidity measuring apparatus, such as model 150B Taber Stiffness Tester (available from TABER INSTRUMENT—A TELEDYNE COMPANY). The support is, in general, different in rigidity between in the longitudinal and width directions, and at least one of them is preferably within the stated range. When the Taber stiffness is less than 0.8, it produces problems such as tracking problem occurred in automatic processors. The surface of the support may be roughened randomly or smoothed. In the case of the smooth surface, the roughness of the surface is continuously measured, a power spectrum obtained through frequency analysis of high-speed Fourier transformation of measured signals is integrated in the frequency range of 1 to 12.5 mm, and a square root of the integrated value obtained (called a PY value) is preferably nor more than 2.9 $\mu$m. The PY value is more preferably not more than 1.8 $\mu$m and still more preferably not more than 1.15 $\mu$m. The lower limit thereof is 0. Measurement of the surface roughness can be made using a film thickness continuously measuring machine (e.g., produced by ANRITSU Corp.) Frequency analysis of the obtained measurement signals can be made using a frequency analyzer (e.g., VC-2403 available from HITACHI DENSHI Co. Ltd.).

White pigments used in the support include inorganic and/or organic white pigments. Specifically, inorganic white pigments are preferred and examples thereof include alkali earth metal sulfates such as barium sulfate, alkali earth metal carbonates such as calcium carbonate, fine powdery silicates, silicas such as synthetic silicates, calcium silicate, alumina, alumina hydrate, titanium oxide, talc and clay. Of these, barium sulfate or titanium oxide white pigment is preferred. The white pigment to be incorporated into a surface water resistant resin layer is preferably not less than 13 wt %, and more preferably not less than 15 wt % to improve sharpness. Dispersity of a white pigment incorporated into the water resistant resin layer can be measured according to the method described in JP-A 2-28640. A coefficient of variation of the dispersity is preferably not more than 0.20, and more preferably not more than 0.15. The resin layer of the paper support having on both sides resin layers may be comprised of a single layer or plural layers. In the case of plural layers, incorporation of the white pigment in a higher concentration into a layer in contact with an emulsion layer leads to markedly enhanced sharpness and is suited to form images used for proofing. The center-line mean roughness value (SRa value) of a support is preferably not more than 0.15 $\mu$m, and more preferably not more than 0.12 $\mu$m in terms of glossiness. It is preferred to incorporate a small amount of a blueing agent or an agent for making reddish, such as ultramarine blue or oil-soluble dyes into the white pigment containing water resistant resin layer or a hydrophilic coating layer to adjust spectral reflection balance of the background, improving whiteness.

The support may be coated after subjecting the support to surface finishing such as corona discharge, UV ray irradiation and flame treatment, prior to coating, directly or through one or more sublayers (to enhance surface characteristics such as adhesion property, antistatic property, dimensional stability, friction resistance, hardness, antihalation and other characteristics). In the coating of photographic materials using a silver halide emulsion, a thickening agent may used to enhance coatability. Extrusion coating and curtain coating are preferred, whereby two or more layers can be simultaneously coated.

Commonly known aromatic primary amine developing agents can be used in the invention. Examples thereof include:

CD-1; N,N-diethyl-p-phenylenediamine

CD-2; 2-amino-5-ethylaminotoluene

CD-3; 2-amino-5-(N-ethyl-N-laurylamino)toluene

CD-4; 4-(N-ethyl-N-(β-hydroxyethyl)amino)aniline

CD-5; 2-methyl-4-(N-ethyl-N-(β-hydroxyethyl)amino)-aniline

CD-6; 4-amino-3-methyl-N-ethyl-N-(P-methansulfonamido)-ethyl)-aniline

CD-7; N-(2-amino-5-diethylaminophenylethyl)methane-Sulfonamide

CD-8; N, N-dimethyl-p-phenylenediamine

CD-9; 4-amino-3-methyl-N-ethyl-N-methoxyethylaniline

CD-10; 4-amino-3-methyl-N-ethyl-N-(β-ethoxyethyl)-aniline

CD-11; 4-amino-3-methyl-N-ethyl-N-(γ-hydroxypropyl)-Aniline.

A color developing solution may be used at any pH value, and the PH is preferably 9.5 to 13.0, and more preferably 9.8 to 12.0 in terms of rapid processing. The processing temperature of the color developing solution is preferably not lower than 35° C. and not higher than 70° C., and more preferably 37 to 60° C. in terms of stability of the developing solution. The developing solution, in addition to a developing agent, may further contain developer ingredient compounds, including an alkaline agent having buffering action, chloride ion, antifoggants such as benzotriazole, preservative, and a chelating agent.

After color development, the silver halide photographic materials are further subjected to bleaching and fixing. Bleaching and fixing may be simultaneously conducted. After fixing, the photographic materials are usually subjected to washing. The washing may be replaced by a stabilization treatment. Specifically, in the case of continuous unattended operation, such stabilization treatment is preferred. Apparatuses for processing the photographic materials used in the invention include a roller transport type, in which the photographic materials are allowed to transport between rollers arranged in a processing tank; endless belt system, in which the photographic material is fixed onto a belt and transported, a system in which the photographic material is transported through a slit-formed processing bath with supplying a processing solution thereto; a spray system in which the processing solution is sprayed onto the photographic material; a web system in which the photographic material is brought into contact with a carrier impregnated with the processing solution and a system using a viscous processing solution. A large amount of photographic materials are usually subjected to running processing using an automatic processor. In this case, the less replenishing rate is preferred for environment protection. One preferred processing mode suitable for the environment protection is a replenishment in which a processing replenisher is added in the of a solid tablet, as described in KOKAI GIHO (Technical Disclosure) No. 94-16935.

Preferred embodiments of the invention are described below:

(1) a silver halide light sensitive photographic material, comprising a silver halide emulsion containing a sensitizing dye exhibiting an absorption maximum at the wavelength of 730 nm or longer (hereinafter, also denoted as $\lambda max \geqq 730$ nm) and which has been chemically sensitized, characterized in that the pAg of the emulsion is adjusted to 7.50 to 8.25 at the time during after starting chemical sensitization and before adding the sensitizing dye;

(2) a silver halide light sensitive photographic material, comprising a silver halide emulsion containing a sensitizing dye exhibiting $\lambda max \geqq 730$ nm and which has been chemically sensitized, characterized in that the pAg of the emulsion is adjusted to 7.65 to 8.10 at the time during after starting chemical sensitization and before adding the sensitizing dye;

(3) the silver halide photographic material described in (1) above, characterized in that a halide salt is added to adjust the pAg to 7.50 to 8.25;

(4) the silver halide photographic material described in (1) above, characterized in that a halide salt is added to adjust the pAg to 7.65 to 8.10;

(5) the silver halide photographic material described in (3) or (4) above, characterized in that the halide salt is a chloride salt;

(6) the silver halide photographic material described in (3) or (4) above, characterized in that the halide salt is a bromide salt;

(7) a silver halide light sensitive photographic material, comprising a silver halide emulsion containing a sensitizing dye exhibiting $\lambda max \geqq 730$ nm and which has been chemically sensitized, characterized in that a mercapto compound is added to the emulsion at the time during after starting chemical sensitization and before adding the sensitizing dye;

(8) the silver halide photographic material described in (7) above, characterized in that the mercapto compound is represented by formula (I) or (II) afore-described;

(9) the silver halide photographic material described in (7) above, characterized in that the mercapto compound is at least one of the mercapto compounds ME-1 to ME-13;

(10) the silver halide photographic material described in (9) above, characterized in that the mercapto compound is contained in an amount of 1×10–5 to 1×10–3 mole per mole of silver halide;

(11) a silver halide light sensitive photographic material, comprising a chemically sensitized silver halide emulsion containing a sensitizing dye exhibiting λmax≧730 nm, characterized in that a deflocculating agent is added to the emulsion at the time during after starting chemical sensitization and before adding the sensitizing dye;

(12) the silver halide photographic material described in (11) above, characterized in that the deflocculation agent is at least one of exemplified compounds d-1 to d-9;

(13) a silver halide light sensitive photographic material, comprising a chemically sensitized silver halide emulsion containing a sensitizing dye exhibiting λmax≧730 nm, characterized in that the pH of the emulsion is adjusted to 4.9 to 7.5 at the time during after starting chemical sensitization and before adding the sensitizing dye;

(14) a silver halide light sensitive photographic material, comprising a chemically sensitized silver halide emulsion containing a sensitizing dye exhibiting λmax≧730 nm, characterized in that the pH of the emulsion is adjusted to 4.9 to 6.9 at the time during after starting chemical sensitization and before adding the sensitizing dye;

(15) a silver halide light sensitive photographic material, comprising a chemically sensitized silver halide emulsion containing a sensitizing dye exhibiting λmax≧730 nm, characterized in that after adding the sensitizing dye to the emulsion, the emulsion exhibits a tf value of not more than $3.7\times10^{-12}$ at 10° C.;

(16) a silver halide light sensitive photographic material, comprising a chemically sensitized silver halide emulsion containing a sensitizing dye exhibiting λmax≧730 nm, characterized in that after adding the sensitizing dye to the emulsion, the emulsion exhibits a tf value of not more than $1.2\times10^{-12}$ at 10° C.;

(17) a silver halide light sensitive photographic material, comprising a chemically sensitized silver halide emulsion containing a sensitizing dye exhibiting λmax≧730 nm, characterized in that after adding the sensitizing dye to the emulsion, the emulsion exhibits a tf value of not less than $2.6\times10^{-13}$ and not more than $9.5\times10^{-11}$ at 10° C.;

(18) a silver halide light sensitive photographic material, comprising a chemically sensitized silver halide emulsion containing a sensitizing dye exhibiting λmax≧730 nm, characterized in that after adding the sensitizing dye to the emulsion, the emulsion exhibits a tf value of not less than $2.6\times10^{-13}$ and not more than $4.7\times10^{-13}$ at 10° C.;

(19) a silver halide light sensitive photographic material, comprising a chemically sensitized silver halide emulsion containing a sensitizing dye exhibiting λmax≧730 nm, characterized in that the pAg and the pH of the emulsion are adjusted to 7.50 to 8.25 and 4.9 to 7.5, respectively, at the time during after starting chemical sensitization and before adding the sensitizing dye;

(20) the silver halide light sensitive photographic material, comprising a chemically sensitized silver halide emulsion containing a sensitizing dye exhibiting λmax≧730 nm, as described in any of (1) to (19), characterized in that the emulsion contains not less than 95 mol % chloride; and

(21) a silver halide light sensitive photographic material, comprising a chemically sensitized silver halide emulsion containing a sensitizing dye exhibiting λmax≧730 nm, as described in any of (1) to (20), characterized in that the emulsion is chemically sensitized using chloroauric acid.

EXAMPLES

The present invention will be further explained based on examples but embodiments of the invention are not limited to these examples.

Example 1

A paper support was prepared by laminating high density polyethylene on both sides of raw paper of 180 g/m$^2$ weight. Further, on emulsion side thereof, polyethylene melt containing 15 wt % surface-modified anatase type titanium oxide was laminated to prepare a reflection support. After subjecting the reflection support to corona discharge, a gelatin sublayer was coated on the support, and further thereon, the following layers were coated to prepare silver halide photographic material Sample 101. Coating solutions were prepared as follows.

First Layer Coating Solution

To 23.4 g of yellow coupler (Y-1), 3.34 g of dye image stabilizing agent (ST-1), 3.34 g of (ST-2), 3.34 g of (ST-3), 0.34 g of anti-staining agent (HQ-1), 5.0 g of image stabilizer A, 3.33 g of high boiling organic solvent (DBP) and 1.67 g of high boiling organic solvent (DNP) was added 60 ml of ethyl acetate and dissolved. The solution was dispersed in 220 ml of an aqueous 10% gelatin solution containing 7 ml of an aqueous 20% surfactant (SU-l) solution, using an ultrasonic homogenizer to obtain an emulsified yellow coupler dispersion. The dispersion was mixed with an infrared-sensitive silver halide emulsion, which was prepared according to the following conditions and a 1st layer coating solution was obtained. Coating solution of the 2nd layer to the 7th layer were similarly prepared and coated so as to have a coating amount shown below. Hardening agents (H-1) and (H-2) were also added. Surfactants (SU-2) and (SU-3) ere added to adjust the surface tension. Further, (F-1) was added to each layer, in total amounts of 0.04 g/m$^2$.

| Layer | Composition | Addition Amount (g/m$^2$) |
|---|---|---|
| 7th layer (Protective Layer) | Gelatin | 1.00 |
| | DIDP | 0.002 |
| | DBP | 0.002 |
| | Silicon dioxide | 0.003 |
| 6th layer (UV absorbing layer) | Gelatin | 0.40 |
| | UV absorber (UV-1) | 0.12 |
| | UV absorber (UV-2) | 0.04 |

-continued

| Layer | Composition | Addition Amount ($g/m^2$) |
|---|---|---|
| | UV absorber (UV-3) | 0.16 |
| | Antistaining agent (HQ-5) | 0.04 |
| | PVP | 0.03 |
| | Antiirradiation dye (AI-1) | 0.01 |
| 5th layer (Red-sensitive layer) | Gelatin | 1.30 |
| | Red-sensitive Emulsion (Em-R101) | 0.21 |
| | Cyan coupler (C-1) | 0.25 |
| | Cyan coupler (C-2) | 0.08 |
| | Dye image stabilizer (ST-1) | 0.10 |
| | Antistaining agent (HQ-1) | 0.004 |
| | DBP | 0.10 |
| | DOP | 0.20 |
| 4th layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | Antistaining Agent (HQ-5) | 0.10 |
| | Antiirradiation dye (AI-1) | 0.02 |
| 3rd layer (Green-sensitive layer) | Gelatin | 1.30 |
| | Green-sensitive emulsion (Em-G101) | 0.14 |
| | Magenta coupler (M-1) | 0.20 |
| | Color image stabilizer (ST-3) | 0.20 |
| | Color image stabilizer (ST-4) | 0.17 |
| | DIDP | 0.13 |
| | DBP | 0.13 |
| | Antiirradiation dye (AI-2) | 0.01 |
| 2nd layer (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.04 |
| | DBP | 0.02 |
| | Optical brightening agent (W-1) | 0.10 |
| | Antiirradiation dye (AI-3) | 0.02 |
| | Antiirradiation dye (AI-4) | 0.02 |
| 1st layer | Gelatin | 1.20 |

-continued

| Layer | Composition | Addition Amount ($g/m^2$) |
|---|---|---|
| (Blue-sensitive layer) | Infrared-sensitive emulsion (Em-I101) | 0.26 |
| | Yellow coupler (Y-1) | 0.70 |
| | Color image stabilizer (ST-1) | 0.10 |
| | Color image stabilizer (ST-2) | 0.10 |
| | Color image stabilizer (ST-5) | 0.10 |
| | Image stabilizer A | 0.15 |
| | Antistaining agent (HQ-1) | 0.01 |
| | DBP | 0.10 |
| | DNP | 0.05 |
| Support | Polyethylene laminated paper (containing a small amount of colorant) | |

Further, the coating amount of silver halide is represented by equivalent converted to silver.

SU-1: sodium tri-i-propylnaphthalenesulfonate
SU-2: sulfosuccinic acid di(2-ethylhexyl) sodium salt
SU-3: sulfosuccinic acid di(2,2,3,3,4,4,5,5-octafluoropentyl)sodium salt
DBP: dibutyl phthalate
DNP: dinonyl phthalate
DOP: dioctyl phthalate
DIDP: diisodecyl phthalate
PVP: polyvinyl pyrrolidone
H-1: tetrakis(vinylsulfonylmethyl)methane
H-2: 2,4-dichloro-6-hydroxy-s-triazine sodium
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl)butylhydroquinone
Image stabilizer A: p-octylphenol

ST-1

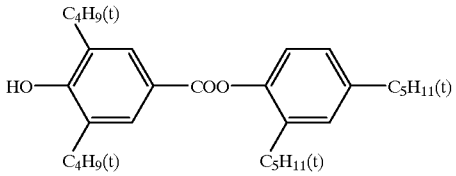

C-1

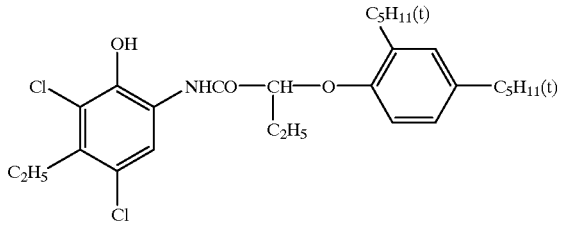

C-2

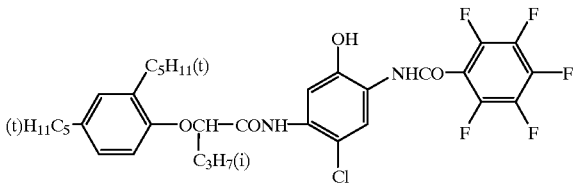

Y-1

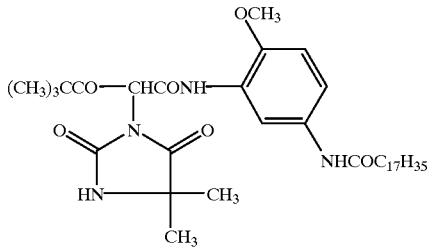

ST-2

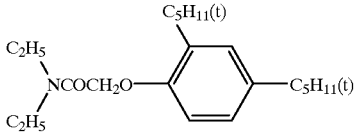

M-1

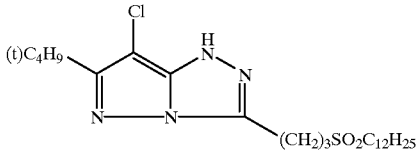

-continued

ST-3

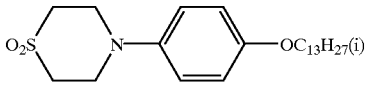

ST-4

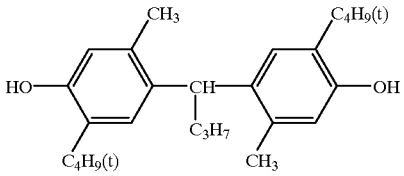

ST-5

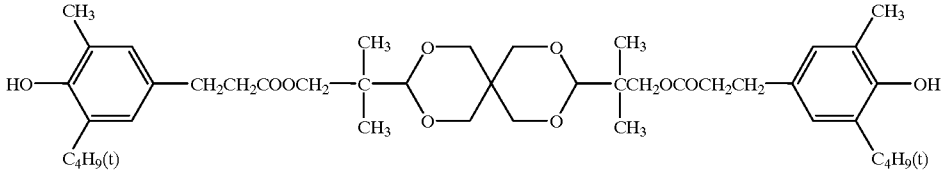

UV-1

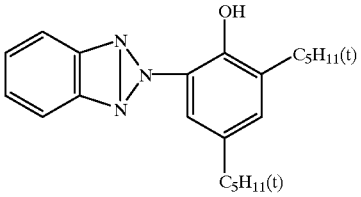

UV-2

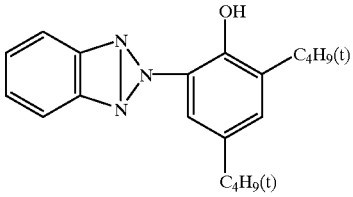

UV-3

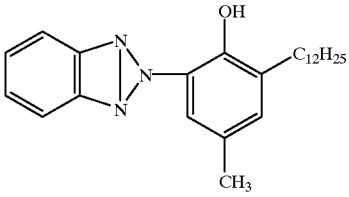

W-1

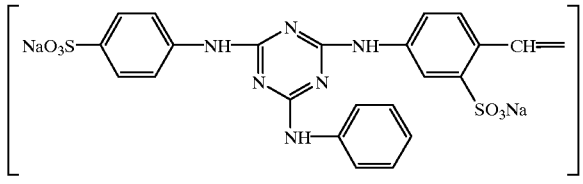

A-1

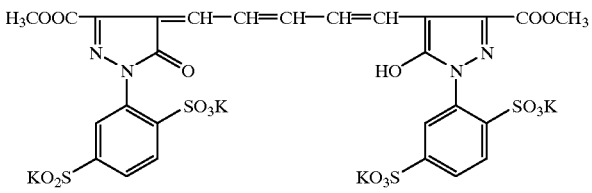

A-2

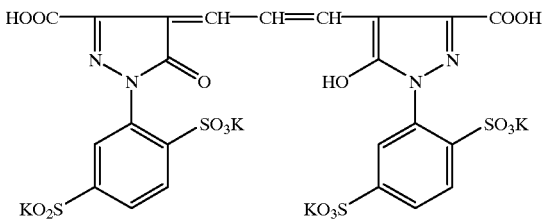

Al-3

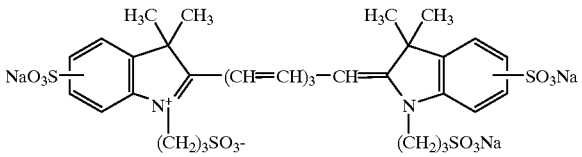

F-1

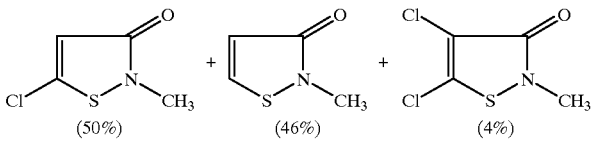

Mixture (50:46:4, molar ratio)

Al-4

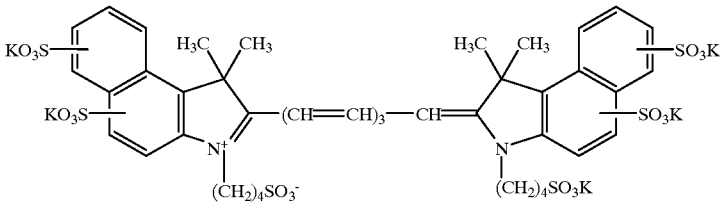

Preparation of Infrared-sensitive Silver Halide Emulsion

To 1 liter of an aqueous 2% gelatin solution heated at 40° C., the following solution A and solution B were simultaneously added while controlling at pAg=7.3, pH=3.0, and further, the following solution C and solution D were simultaneously added while being controlled at pAg=8.0 and pH=5.5. At this time, the pAg was controlled according to the method described in JP-A 59-45437 and the pH was controlled using sulfuric acid or an aqueous sodium hydroxide solution.

| | |
|---|---|
| (Solution A) | |
| Sodium chloride | 3.42 g |
| Potassium bromide | 0.03 g |
| Water to make | 200 ml |
| (Solution B) | |
| Silver nitrate | 10 g |
| Water to make | 200 ml |
| (Solution C) | |
| Sodium chloride | 102.7 g |
| Potassium hexachloroiridium (IV) | $4 \times 10^{-8}$ mole |
| Potassium hexacyanoferrate (II) | $2 \times 10^{-5}$ mole |
| Potassium bromide | 1.0 g |
| Water to make | 600 ml |
| (Solution D) | |
| Silver nitrate | 300 g |
| Water to make | 600 ml |

After completing the addition, soluble salts were removed using an aqueous 5% Demol N (manufactured by Kao Atlas Co.) solution and an aqueous 20% magnesium sulfate solution followed by mixing with an aqueous gelatin solution. Thus, a monodispersed cubic grain emulsion, EMP-101 was prepared which had an average grain diameter of 0.45 $\mu$m, a variation coefficient of grain diameter distribution of 0.07, and a chloride content of 99.5 mole %. The emulsion EMP-1A was subjected optimally to chemical sensitization at 60° C. using the following compounds.

| | |
|---|---|
| Sodium thiosulfate | 0.8 mg/mole AgX |
| Chloroauric acid | 0.5 mg/mole AgX |

Further, to the chemically sensitized emulsion EMP-101, the following sensitizing dyes IS-1 and IS-2 were added to obtain infrared-sensitive silver halide emulsion Em-I101. Before adding the dye IS-1, the pAg of the chemically sensitized emulsion (EMP-101) was adjusted to a value as shown in Table 1.

| | |
|---|---|
| Sensitizing dye IS-1 | $0.5 \times 10^{-4}$ mole/mole AgX |
| Sensitizing dye IS-2 | $0.5 \times 10^{-4}$ mole/mole AgX |

Subsequently, the following compounds were added to obtain infrared-sensitive emulsion EMI101. Similarly, emulsions Em-I102 to Em-I107 were prepared.

| | |
|---|---|
| Stabilizer ME-2 | $3 \times 10^{-4}$ mole/mole AgX |
| Stabilizer ME-7 | $3 \times 10^{-4}$ mole/mole AgX |
| Stabilizer ME-11 | $3 \times 10^{-4}$ mole/mole AgX |

Further, infrared-sensitive emulsions Em-I108 to Em-I113 were prepared in the same manner as Em-I103, except that a sensitizing dye was varied as shown in Table 3.

Preparation of Green-sensitive Silver Halide Emulsion

Monodispersed cubic grain emulsions EMP-102 and EMP-103 were prepared in the same manner as in the preparation of EMP-101 except that the addition period of solution A and solution B, and the addition period of solution C and solution D were varied. The emulsion EMP-102 had an average grain diameter of 0.40 $\mu$m, a variation coefficient of 0.08 and a chloride content of 99.5 mole %, and EMP-103 had an average grain diameter of 0.50 $\mu$m, a variation coefficient of 0.08 and a chloride content of 99.5 mole %. The emulsion, EMP-102 was subjected to optimum chemical sensitization at 55° C. using the following compounds. The emulsion, EMP-103 was also subjected to chemical sensitization in a similar manner. The sensitized EMP-102 and EMP-103 were mixed in a ratio of 1:1 in terms of silver amount and a green-sensitive silver halide emulsion (Em-G101) was obtained.

| | |
|---|---|
| Sodium thiosulfate | 1.5 mg/mole AgX |
| Chloroauric acid | 1.0 mg/mole AgX |
| Stabilizer ME-2 | $3 \times 10^{-4}$ mole/mole AgX |
| Stabilizer ME-7 | $3 \times 10^{-4}$ mole/mole AgX |
| Stabilizer ME-11 | $3 \times 10^{-4}$ mole/mole AgX |
| Sensitizing dye GS-1 | $4 \times 10^{-4}$ mole/AgX |

Preparation of Red-sensitive Silver Halide Emulsion

Monodispersed cubic grain emulsions EMP-104 and EMP-105 were prepared in the same manner as in the preparation of EMP-101 except that the addition period of solution A and solution B, and the addition period of solution C and solution D were changed. The EMP-104 had an average grain diameter of 0.40 $\mu$m, a variation coefficient of 0.08 and a silver chloride content of 99.5 mole %, and EMP-105 had an average grain diameter of 0.38 $\mu$m, a variation coefficient of 0.08 and a silver chloride containing ratio of 99.5 mole %. The aforementioned EMP-104 was subjected to optimum chemical sensitization at 60° C. using the following compounds. EMP-105 was also subjected to chemical sensitization in the same manner. The sensitized EMP-104 and EMP-105 were mixed in a ratio of 1:1 in terms of silver amount and a red-sensitive silver halide emulsion (Em-101) was obtained.

| | |
|---|---|
| Sodium thiosulfate | 1.8 mg/mole AgX |
| Chloroauric acid | 2.0 mg/mole AgX |
| Stabilizer ME-2 | $3 \times 10^{-4}$ mole/mole AgX |
| Stabilizer ME-7 | $3 \times 10^{-4}$ mole/mole AgX |
| Stabilizer ME-11 | $3 \times 10^{-4}$ mole/mole AgX |
| Sensitizing dye RS-1 | $1 \times 10^{-4}$ mole/AgX |
| Sensitizing dye RS-2 | $1 \times 10^{-4}$ mole/AgX |

Further, $2.0 \times 10^{31\ 3}$ mole/mole AgX of compound d-9 was added to the red-sensitive emulsion. Samples 102 to 112 were prepared in the same manner as Sample 101, except that infrared-sensitive emulsion Em-I101 was replaced by Em-I102 to Em-I112.

Samples 101 through 112 each were exposed using Wratten 47B filter (available from Eastman Kodak Co.) and processed according to the following processing steps. Obtained yellow images were measured using densitometer PDA-65 (available from Konica Corp.) to determine sensitivity. The sensitivity was represented by a relative value of reciprocal of exposure necessary to obtain a density of 0.3 plus a fog density, based the sensitivity of Sample 101 being 100. Similarly, unexposed samples each were processed and obtained yellow densities were measured using densitometer X-Rite (available from X-Rite Corp.). Fog was represented by a relative value, based on the fog of Sample 101 being 0.

| Step | Temperature | Time | Repl. rate* |
|---|---|---|---|
| Color developing | 38.0 ± 0.3° C. | 45 sec. | 80 ml |
| Bleach-fixing | 35.0 ± 0.5° C. | 45 sec. | 120 ml |
| Stabilizing | 30–34° C. | 60 sec. | 150 ml |
| Drying | 60–80° C. | 30 sec. | |

*Replenishing rate

Processing solution compositions are as follows. Color developer, worker and replenisher solutions

| | Worker | Replenisher |
|---|---|---|
| Water | 800 ml | 800 ml |
| Triethylene diamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-(β-hydroxyethyl)-4-aminoanilinw sulfate | 6.0 g | 10.0 g |
| N,N-diethylhydroxyamine | 6.8 g | 6.0 g |
| Triethanolamine | 10.0 g | 10.0 g |
| Sodium diethylenetriamine-pentaacetate | 2.0 g | 2.0 g |
| Brightener (4,4'-diaminostilbene sulfonic acid derivative | 2.0 g | 2.5 g |
| Potassium carbonate | 30 g | 30 g |

Water is added to make a total volume of 1 lit. and the pH of the worker and replenisher is adjusted to 10.10 and 10.60, respectively.

Bleach-fixer, worker and replenisher solutions

| | |
|---|---|
| Ammonium ferric diethylenetriaminepenta-acetate dihydride | 65 g |
| Diethylenetriaminepentaacetic acid | 3 g |
| Ammonium thiosulfate (70% aq. solution) | 100 ml |
| 2-Amino-5-mercapto-1,3,4-thiadiazole | 2.0 g |
| Ammonium sulfite (40% aq. solution) | 27.5 ml |

Water was added to make 1 lit. and the pH was adjusted to 5.0 with potassium carbonate or glacial acetic acid.

Stabilizer, worker and replenisher solutions

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (45% aq. Solution) | 0.65 g |
| Magnesium sulfate hepta-hydrate | 0.2 g |
| PVP (polyvinyl pyrrolidone) | 1.0 g |
| Ammonia water (aq. 25% ammonium hydroxide) | 2.5 g |
| Sodium ethylenediaminetetraacetate | 1.5 g |

Water was added to make 1 lit. and the pH was adjusted to 7.5 with sulfuric acid or ammonia water.

TABLE 1

| Sample | pAg | Dye (mol/molAgx) | Sensitivity | Fog | Remark |
|---|---|---|---|---|---|
| 101 | 7.46 | IS-1 + IS-2 (each, $0.5 \times 10^{-4}$) | 100 | 0 | Comp. |
| 102 | 7.53 | ditto | 108 | −0.14 | Inv. |
| 103 | 7.65 | ditto | 110 | −0.21 | Inv. |
| 104 | 8.10 | ditto | 115 | −0.20 | Inv. |
| 105 | 8.20 | ditto | 115 | −0.18 | Inv. |
| 106 | 8.31 | ditto | 110 | −0.09 | Comp. |
| 107 | 8.35 | ditto | 112 | 0.01 | Comp. |
| 108 | 7.65 | IS-1 ($1.0 \times 10^{-4}$) | 103 | −0.22 | Inv. |
| 109 | 7.65 | IS-1 ($1.0 \times 10^{-4}$) | 111 | −0.22 | Inv. |
| 110 | 7.65 | IS-2 ($1.0 \times 10^{-4}$) | 108 | −0.20 | Inv. |
| 111 | 7.65 | IS-3 ($1.0 \times 10^{-4}$) | 96 | −0.19 | Inv. |
| 112 | 7.65 | IS-9 ($1.0 \times 10^{-4}$) | 104 | −0.21 | Inv. |

As is apparent from Table 1, the use of the inventive emulsions which were each adjusted to a pAg of 7.50 to 8.25 before adding a sensitizing dye led to higher sensitivity and lower fog, as compared to comparative emulsions. Specifically, the difference in effects between the pAg of 7.46 and 7.53, or between the pAg of 8.20 and 8.31 was marked; and the pAg of 7.58 to 8.15 resulted in further lower fog. Furthermore, it was preferred that although the sensitizing dyes used in the invention resulted in difference in sensitivity in some degree, depending on the kind of the sensitizing dye, fog-restraining effects were marked even when the sensitizing dye was used alone or the dye was replaced by another one.

Example 2

Silver halide emulsions Em-I201 to I206 were prepared in a manner similar to emulsion Em-I101 of Example 1, except that before adding sensitizing dyes IS-1 and IS-2, the pH and pAg were respectively adjusted to values as shown in Table 2 using sulfuric acid or sodium hydroxide, and sodium chloride. Photographic material samples 201 to 206 were prepared in a manner similar to Sample 101 of Example 1, except that emulsion Em-I101 was replaced by Em-I201 to Em-I206. Obtained samples 201 to 206 were each evaluated in the same manner as in Example 1. Sensitivity was represented by a relative value, based on the sensitivity of Sample 201 being 100, and fog was also represented by a relative value, based on the fog of Sample 201 being 0.

TABLE 2

| Sample | pAg | pH | Sensitivity | Fog |
|---|---|---|---|---|
| 201 | 7.46 | 4.61 | 100 | 0 |
| 202 | 7.54 | 4.90 | 106 | −0.05 |
| 203 | 7.70 | 5.31 | 120 | −0.19 |
| 204 | 7.91 | 6.20 | 125 | −0.18 |
| 205 | 8.38 | 7.01 | 126 | −0.04 |
| 206 | 8.61 | 7.62 | 128 | +0.08 |

As can be seen from the Table, when the pAg is adjusted to be 7.5 to 8.25 and pH is adjusted to be 4.9 to 7.5, fog-restraining effects were marked.

Samples 201 to 206 were also exposed using an exposure apparatus to undergo area modulation mode exposure, as described below, and processed in the same manner as in Example 1 to form halftone images. The yellow density of unexposed areas of each sample was measured by densitometer X-Rite 310 (available from X-Rite Corp.) with respect to a fog density. The fog density was represented by a relative value, based on the fog density of 201 being 0.

Exposure Apparatus

Infrared light source: Semiconductor laser (GaAlAs:785 nm)

Red light source: Semiconductor laser (AlGaInAs:650 nm)

Green light source: HeNe laser (544 nm)

The photographic material are wound around a drum with aspirating and imagewise exposed while rotating at a speed of 2,000 rotations per min., wherein 12 infrared lasers are arranged and the photographic material was simultaneously exposed, through optical means, to 12 laser beams. As a result, it was shown that the pAg range according to the invention in combination of the preferred pH range led to halftone images with reduced fog and superior white background. It was further proved that images could be formed by relatively lower laser output, indicating higher sensitivity.

What is claimed is:

1. A method of preparing a silver halide emulsion comprising silver halide grains, the method comprising the steps of:

(i) forming a silver halide emulsion, (ii) subjecting the silver halide emulsion to chemical sensitization, and (iii) adding a sensitizing dye to the silver halide emulsion, wherein said sensitizing dye exhibits an absorption maximum at a wavelength of not less than 730 nm, said silver halide emulsion comprising silver halide grains having a chloride content of not less than 95 mol %, and the pAg of the emulsion being adjusted to a range of from 7.50 to 8.25 after starting the chemical sensitization and before adding said sensitizing dye.

2. The method of claim 1, wherein the pAg is adjusted to a range of from 7.65 to 8.10.

3. The method of claim 1, wherein the pAg is adjusted by adding a water soluble halide.

4. The method of claim 3, wherein said halide is a chloride.

5. The method of claim 3, wherein said halide is a bromide.

6. The method of claim 1, wherein said sensitizing dye is represented by the following formula (IRS-1):

formula (IRS-1)

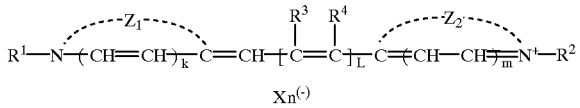

wherein $Z_1$ and $Z_2$ are each an atomic group necessary to form a 5- or 6-membered heterocyclic ring; $R^1$ and $R^2$ are each an alkyl group, an alkenyl group, an alkynyl group or an aralkyl group; $R^3$ and $R^4$ are each a hydrogen atom, alkyl group or an aralkyl group; k and m are each 0 or 1; L is an integer of 3 or more; X— is an acid anion; and n is 0 or 1.

7. The method of claim 1, wherein the pH of the emulsion is adjusted to a range of from 4.9 to 7.5.

8. A silver halide photographic light sensitive material comprising a support having thereon a silver halide emulsion layer comprising a silver halide emulsion, wherein said silver halide emulsion is chemically sensitized and the silver halide emulsion being further spectrally sensitized by adding thereto a sensitizing dye exhibiting an absorption maximum at a wavelength of not less than 730 nm, wherein said silver halide emulsion comprises silver halide grains having a chloride content of not less than 95 mol%, and the pAg of the emulsion is adjusted to a range of from 7.50 to 8.25 after starting the chemical sensitization and before adding said sensitizing dye.

* * * * *